US009243851B2

(12) United States Patent
Viswanathan et al.

(10) Patent No.: US 9,243,851 B2
(45) Date of Patent: Jan. 26, 2016

(54) HEAT EXCHANGE TUBE AND METHOD OF USING THE SAME

(75) Inventors: Aroon K. Viswanathan, Racine, WI (US); Thomas A. Hunzinger, Racine, WI (US); Rifaquat A. Cheema, Kenosha, WI (US)

(73) Assignee: Modine Manufacturing Company, Racine, WI (US)

( * ) Notice: Subject to any disclaimer, the term of this patent is extended or adjusted under 35 U.S.C. 154(b) by 1008 days.

(21) Appl. No.: 13/349,800

(22) Filed: Jan. 13, 2012

(65) Prior Publication Data

US 2012/0180991 A1 Jul. 19, 2012

Related U.S. Application Data

(60) Provisional application No. 61/432,282, filed on Jan. 13, 2011.

(51) Int. Cl.

| | |
|---|---|
| ***F28F 13/12*** | (2006.01) |
| ***F28F 1/02*** | (2006.01) |
| ***F28F 1/40*** | (2006.01) |
| *F28F 3/04* | (2006.01) |

(Continued)

(52) U.S. Cl.

CPC ... *F28F 1/40* (2013.01); *F28F 1/02* (2013.01); *F28F 13/12* (2013.01); *F28D 1/05366* (2013.01); *F28F 3/044* (2013.01); *F28F 13/02* (2013.01); *F28F 2215/04* (2013.01)

(58) Field of Classification Search

CPC ..... F28F 13/12; F28F 3/02; F28F 2001/027; F28F 1/42; F28F 3/042; F28F 3/044; F28F 2215/04; F28F 1/40; F28F 1/02; B21C 37/158; F28D 1/05366

USPC ..... 165/177, 179, 109.1, 153; 138/38

See application file for complete search history.

(56) References Cited

U.S. PATENT DOCUMENTS

| | | | | |
|---|---|---|---|---|
| 4,470,452 | A | 9/1984 | Rhodes | |
| 5,101,891 | A * | 4/1992 | Kadle | 165/152 |
| 5,125,453 | A * | 6/1992 | Bertrand et al. | 165/153 |

(Continued)

FOREIGN PATENT DOCUMENTS

| | | |
|---|---|---|
| CA | 2178513 A1 | 3/1997 |
| JP | 6159986 | 6/1994 |
| JP | H06159986 | 6/1994 |

OTHER PUBLICATIONS

First Office Action with English translation from The State Intellectual Property Office of the People's Republic of China for Chinese Application No. 201210015012.2 dated Jul. 3, 2014 (22 pages).

(Continued)

*Primary Examiner* — Tho V Duong

(74) *Attorney, Agent, or Firm* — Michael Best & Friedrich LLP

(57) ABSTRACT

A heat exchanger tube includes protrusions extending into the internal volume to turbulate a fluid flow for improved heat transfer. The protrusions are arranged to provide dimpled and un-dimpled regions in order to provide increased heat transfer together with decreased pressure drop. A method of transferring heat by flowing a fluid into a tube, turbulating the fluid in a dimpled first tube section, developing a thermal boundary layer in an un-dimpled second section, and turbulating the fluid in a dimpled second tube section is also presented.

7 Claims, 8 Drawing Sheets

(51) Int. Cl.
*F28F 13/02* (2006.01)
*F28D 1/053* (2006.01)

(56) References Cited

U.S. PATENT DOCUMENTS 5,632,331 A * 5/1997 Shinmura ..... 165/153
5,730,213 A 3/1998 Kiser et al.
5,768,782 A * 6/1998 Kato ..... 29/890.053
6,484,398 B2 * 11/2002 Mori et al. ..... 29/890.053
6,510,870 B1 * 1/2003 Valaszkai et al. ..... 138/38
6,904,677 B2 6/2005 Yamauchi
8,267,163 B2 9/2012 Stewart
8,651,170 B2 * 2/2014 Maeda et al. ..... 165/166
2009/0314475 A1 12/2009 Jeon et al.
2010/0044019 A1 * 2/2010 Maeda et al. ..... 165/151

OTHER PUBLICATIONS

Second Office Action of the State Intellectual Property Office of the People's Republic of China dated Mar. 27, 2015 (11 pages).

* cited by examiner

HEAT EXCHANGE TUBE AND METHOD OF USING THE SAME

CROSS-REFERENCE TO RELATED APPLICATIONS

This application claims priority to U.S. Provisional Patent Application No. 61/432,282, filed Jan. 13, 2011, the entire contents of which are hereby incorporated by reference herein.

BACKGROUND

Tubular structures (or "tubes") can be used to convey a fluid through a heat exchanger while transferring thermal energy (heat) to or from another fluid passing over the outer surfaces of the tubes, thereby effecting a transfer of heat while maintaining a physical separation of the two fluids. By way of example, such structures find particular utility in industrial steam generation or process fluid heat exchange, automotive heat exchange components, and space heating and cooling, among other heat transfer applications. The geometry of the tubes themselves varies from application to application, and includes cylindrical, oval, rectangular, as well as other shapes that may be desirable for a given usage.

In many cases it is desirable to increase the rate of heat transfer between the fluid flowing through the tubes and the inner wall surfaces of the tubes, thereby reducing the overall required size of the heat transfer equipment. Such increase can be accomplished by incorporating features to turbulate the fluid as it flows through the tubes, thus eliminating or reducing the formation of a fluid boundary layer on the inner wall surfaces. It is known that a fluid boundary layer inhibits the efficient transfer of heat between the bulk fluid and the wall, due to the need for transfer of the heat energy via conduction through the relatively slow-moving layers of fluid adjacent the walls.

Although many methods of turbulating the flow are known in the art, one method commonly used in certain applications (automotive radiators, by way of an example) includes providing multiple protrusions extending from the tube wall into the fluid volume. These protrusions disrupt the formation of a fluid boundary layer and promote turbulence in the fluid flow in order to improve the rate of heat transfer. Protrusions of this kind are often referred to as "dimples", and such tubes are referred to as "dimpled" tubes.

As a generally undesirable side effect, the turbulence produced by such protrusions also tends to result in an increase in the pumping power required to move the fluid through the tubes. This necessitates a trade-off between the advantages of increased heat transfer performance on the one hand, and the disadvantages of increased pressure drop on the other. Attempts by heat exchanger designers to optimize this trade-off have resulted in the continuous development of new dimple geometries and patterns.

SUMMARY

Some embodiments of the present invention provide a tube to convey a fluid through a heat exchanger. The tube comprises two opposing broad and substantially flat sides extending in a longitudinal direction from a first end of the tube to a second end of the tube to at least partially define a fluid volume therebetween. The tube includes a first plurality of protrusions located between the first and second ends and extending into the fluid volume from one of the two opposing broad and substantially flat sides. The protrusions are aligned along the longitudinal direction and have a first center-to-center spacing in the longitudinal direction between adjacent ones of the first plurality of protrusions. The tube further includes a second plurality of protrusions located between the first plurality of protrusions and the second end and extending into the fluid volume from the one broad and substantially flat side. The second plurality of protrusions are aligned with the first plurality of protrusions along the longitudinal direction and have a second center-to-center spacing in the longitudinal direction between adjacent ones of the second plurality of protrusions. The center-to-center spacing in the longitudinal direction between the one of the first plurality of protrusions located furthest from the first end and the one of the second plurality of protrusions located nearest to the first end is at least 2.5 times the first center-to-center spacing, and said one of the first plurality of protrusions and said one of the second plurality of protrusions are separated by a portion of the one broad and substantially flat side that is substantially absent of protrusions.

In some embodiments the center-to-center spacing in the longitudinal direction between the one of the first plurality of protrusions located furthest from the first end and the one of the second plurality of protrusions located nearest to the first end is at least 2.5 times the second center-to-center spacing.

In some embodiments of the invention the tube further includes a third plurality of protrusions located between the first and second ends and extending into the fluid volume from the other of the two opposing broad and substantially flat sides. The third plurality of protrusions is aligned with the first plurality of protrusions along the longitudinal direction and has a third center-to-center spacing in the longitudinal direction between adjacent ones of the third plurality of protrusions. At least one of the third plurality of protrusions is located further from the first end than any of the first plurality of protrusions and nearer to the first end than any of the second plurality of protrusions.

According to some embodiments of the present invention, the tube comprises two opposing broad and substantially flat sides extending in a longitudinal direction from a first end of the tube to a second end of the tube to at least partially define a fluid volume therebetween. The tube includes a first plurality of protrusions arranged on at least one of the two opposing broad and substantially flat sides and extending into the fluid volume. A first plane normal to the broad and substantially flat sides passes through the centroids of each of the first plurality of protrusions, and has an angle with respect to the longitudinal direction of between 15° and 75°. The tube further includes a second plurality of protrusions arranged on at least one of the two opposing broad and substantially flat sides to define a second plane parallel to the first plane. The second plane passes through the centroids of each of the second plurality of protrusions. The tube still further includes a third plurality of protrusions arranged on at least one of the two opposing broad and substantially flat sides to define a third plane parallel to the first plane, the third plane passing through the centroids of each of the third plurality of protrusions. The tube is substantially absent of additional protrusions on at least one of the two opposing broad and substantially flat sides between the first and second plane and between the second and third plane, and the spacing between the second plane and the third plane is at least two times the spacing between the first plane and the second plane.

In some embodiments the angle between the first plane and the longitudinal direction is between 30° and 60°. In some embodiments the spacing between the second plane and the third plane is at least 2.5 times the spacing between the first plane and the second plane.

Some embodiments of the present invention provide a method of transferring heat between a first fluid and a second fluid, including: directing the first fluid into a tube; turbulating the first fluid in a dimpled first section of the tube; developing a thermal boundary layer of the first fluid in an undimpled second section of the tube downstream of the first section with respect to the flow of the first fluid; turbulating the first fluid in a dimpled third section of the tube downstream of the second section with respect to the flow of the first fluid; and flowing the second fluid over the outside of the tube to transfer heat between the second fluid and the first fluid in the first, second and third sections of the tube.

In some embodiments the first fluid is an engine coolant and the second fluid is air. In some such embodiments the tube is one of several tubes of a radiator.

DETAILED DESCRIPTION

Before any embodiments of the invention are explained in detail, it is to be understood that the invention is not limited in its application to the details of construction and the arrangement of components set forth in the following description or illustrated in the accompanying drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
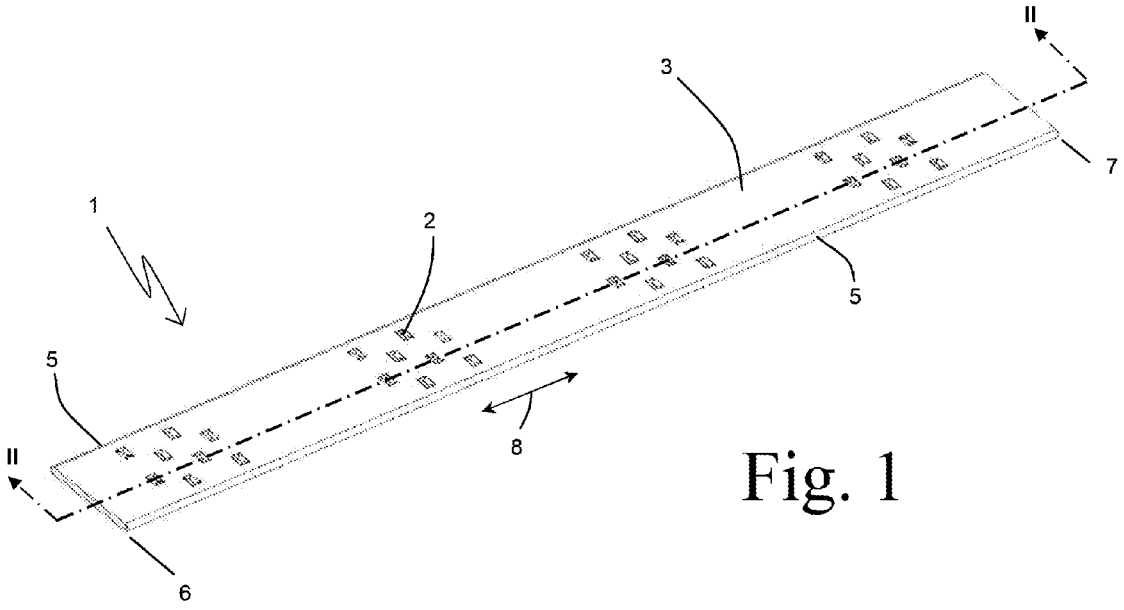
FIG. 1 is a perspective view of a tube according to an embodiment of the invention.
Figure 2:
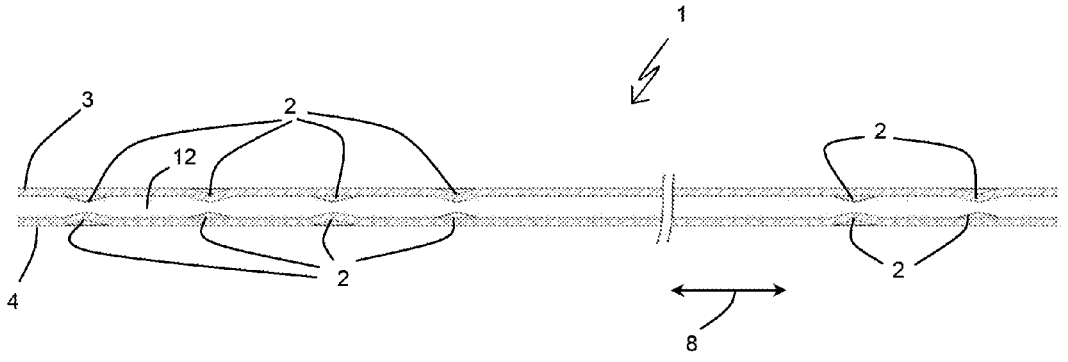
FIG. 2 is a sectional view along the lines II-II of FIG. 1.

A heat exchanger tube 1 according to an embodiment of the present invention is depicted in FIGS.1 and 2. The heat exchanger tube 1 includes opposing broad and substantially flat sides 3 and 4, joined by shorter or narrow sides 5 to define a fluid volume 12 within the tube 1. The shorter sides 5 can be arcuate in shape as shown, or alternatively they can be of some other shape such as, for example, straight. The tube 1 extends in a longitudinal direction (parallel to the narrow sides 5) indicated by the double-ended arrow 8, between a first end 6 of the tube 1 and a second end 7 of the tube 1.

The tube 1 further includes multiple protrusions 2 arranged on the broad and substantially flat faces 3, 4 and extending into the fluid volume 12. The protrusions 2 serve to turbulate a flow of fluid traveling through the fluid volume 12, thereby increasing the rate of heat transfer between the fluid and the tube walls, as will be explained with reference to FIGS. 3 and 4.

Figure 3:
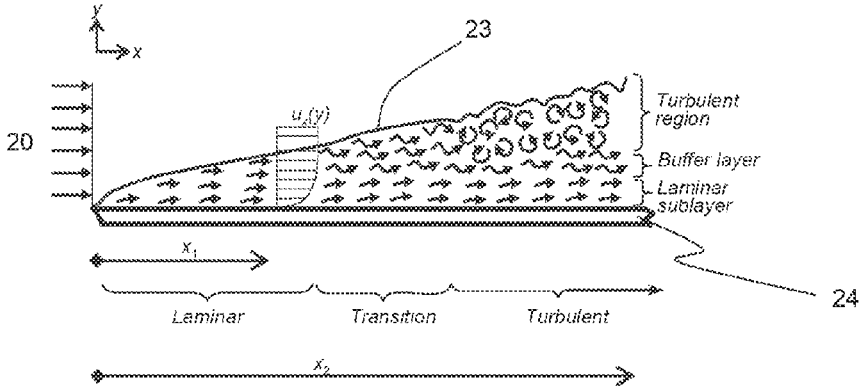
FIG. 3 is a diagram showing the formation of a boundary layer on a plain wall section.

FIG. 3 illustrates the formation of a fluid boundary layer 23 on the surface of a wall 24 as a fluid 20 flows over the wall 24 in the x-direction. The wall 24 in this case can represent a portion of a broad and substantially flat wall of a heat exchanger tube, with the direction "x" corresponding to the longitudinal direction of the tube. Motion of the fluid directly at the wall 24 is inhibited by friction effects and, due to the fluid's viscosity, the velocity of the fluid 20 gradually increases with the distance normal to the wall (the y-direction in FIG. 3) until such distance where the viscous effects are fully dissipated, at which point the fluid is traveling at its free stream velocity. The boundary layer thickness, represented by the line 23, is typically defined to be the distance from the wall whereat the fluid velocity in the longitudinal direction "x" is equivalent in magnitude to 99% of the free stream velocity. The velocity magnitude distribution through the boundary layer at the location $x_1$ is indicated in FIG. 3 as $u_x(y)$.

With continuing reference to FIG. 3, at some distance from the leading edge of the wall 24 the boundary layer begins to transition from laminar flow to turbulent flow. Fluctuations in the fluid begin to develop, as indicated by the squiggly arrows in the boundary layer. Eventually these fluctuations transition to completely turbulent flow, as represented by the arrows depicting a rotational flow pattern. Once the boundary layer has become turbulent, it can be seen to be composed of three separate layers: a laminar sublayer located immediately adjacent to the wall 24, wherein transport is dominated by diffusion effects; a turbulent region located furthest from the wall 24, wherein transport is dominated by turbulent mixing; and a buffer layer between the two, wherein substantial turbulent mixing and diffusion occur simultaneously.

Figure 4:
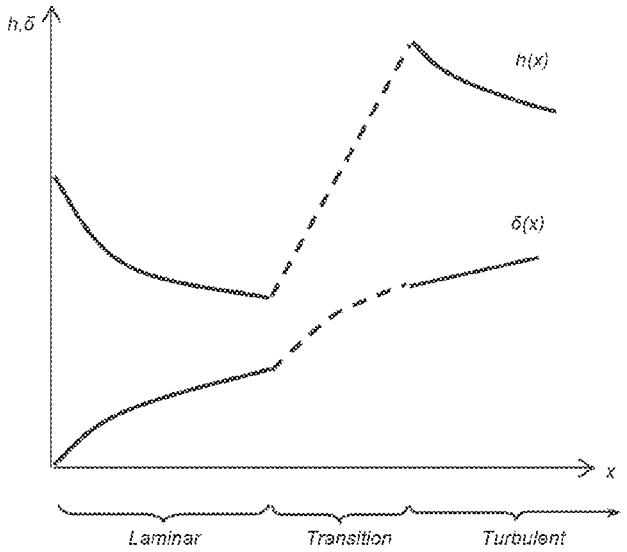
FIG. 4 is a graph showing the relative magnitudes of heat transfer coefficient and boundary layer thickness for the boundary layer of FIG. 3.

Turning now to FIG. 4 (adapted from the textbook Fundamentals of Heat Transfer by Frank P. Incropera and David P. DeWitt, published by John Wiley & Sons of New York, 1981), the variation of the boundary layer thickness "δ" and the convective film coefficient "h" along the x-direction is displayed. As can be seen, a reduction in the convective film coefficient is concomitant with the increase in boundary layer thickness in the laminar region. However, once the boundary layer begins to transition from laminar to turbulent, the convective film coefficient increases even though the boundary layer thickness also continues to increase. This effect results from the increased rate of energy transport in the fluid caused by the fluid fluctuations. Once the flow is fully turbulent, the convective film coefficient reaches its maximum value. Continuing downstream in the turbulent region, the boundary layer thickness continues to increase, but the convective film coefficient decreases due to the growth of the laminar sublayer. Eventually, at a sufficiently far enough downstream location, the laminar sublayer will increase in thickness to the point where it, too, transitions to turbulence, and the entire cycle repeats.

Recognizing that the rate of heat transfer is maximized by operating with the highest achievable film coefficient, designers of heat exchanger equipment using flat tubes commonly add protrusions to the tubes in order to induce (or "trip") the flow into turbulence substantially sooner than turbulence would occur if the tube wall were smooth. Such tubes are commonly referred to in the art as dimpled tubes. In order to prevent the rebuilding of a relatively thick laminar sublayer, and the resulting decrease in convective film coefficient, multiple protrusions are typically arranged in a regular pattern in order to maintain the turbulent flow condition. As an undesirable side effect, the reduction in flow area caused by the protrusions and the energy dissipation effects of the turbulent eddies also result in a substantial increase in pressure drop as compared to flow in a smooth and un-dimpled tube.

The inventors have realized that in some applications it may be preferable to provide a heat exchanger tube that does not strive to maintain the peak film coefficient, as is described above. In contradistinction to a tube having regularly spaced protrusions, the exemplary tube 1 of FIGS. 1 and 2 includes several pluralities of protrusions 2, each plurality comprising two protrusions aligned with one another along the longitudinal direction 8 and having a spacing therebetween which is smaller than the spacing between adjacent pluralities along the longitudinal direction 8. The two protrusions are aligned with one another such that a plane generally normal to the broad and flat side 3 passes through a centroid of each of the two protrusions. Also, in the illustrated embodiment, the plane that passes through the centroid of each of the two protrusions is parallel to the narrow or short sides 5 of the tube 1.

Figure 5A:
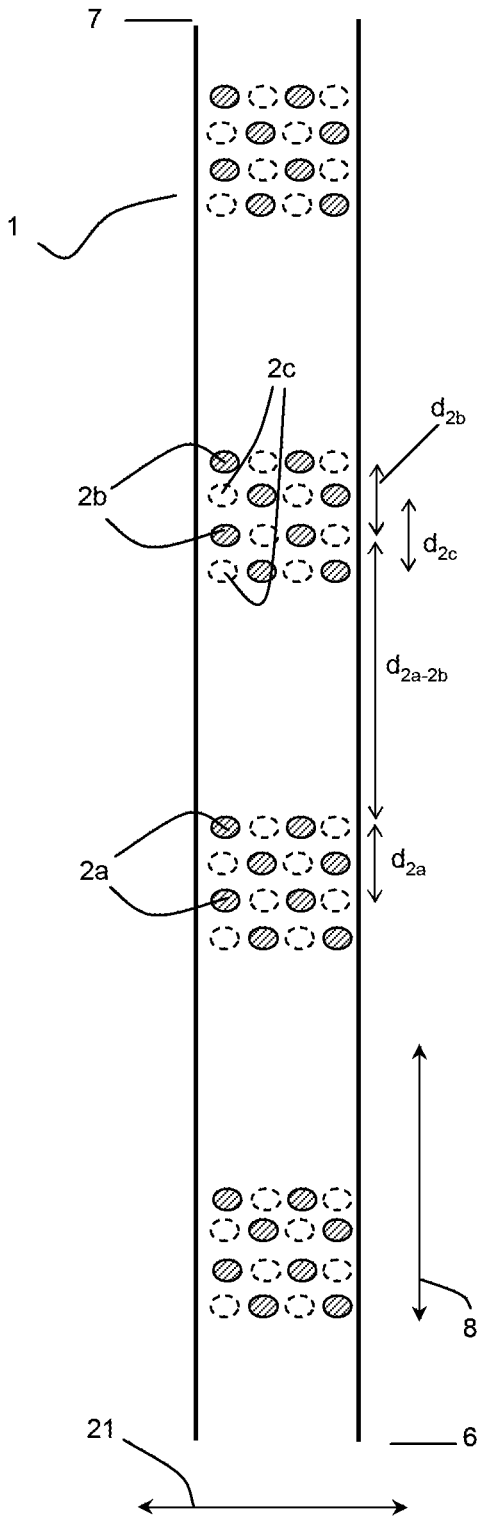
FIGS. 5A-5C are plan views showing three possible variations of a tube according to the embodiment of FIG. 1

A plan view of the exemplary tube 1 of FIGS. 1 and 2 is shown in FIG. 5A. The protrusions 2 located on the wall 3 of the tube 1 are represented by un-hatched circles, whereas the protrusions 2 located on the opposing wall 4 of the tube 1 are represented by hatched circles.

As shown in FIG. 5A, the tube 1 includes a plurality 2*a* of the protrusions 2 located on the broad and substantially flat wall 3 between the first tube end 6 and the second tube end 7. The protrusions 2 within the plurality 2*a* are aligned with one another along the longitudinal direction 8 of the tube 1, and have a spacing $d_{2a}$ in the longitudinal direction 8 between adjacent protrusions of the plurality 2*a*. The two protrusions are aligned with one another such that a plane generally normal to the broad and flat sides 3 and 4 passes through a centroid of each of the two protrusions. Also, in the illustrated embodiment, the plane that passes through the centroid of each of the two protrusions is parallel to the narrow or short sides 5 of the tube 1.

Continuing with reference to FIG. 5A, the tube 1 additionally includes a second plurality 2*b* of the protrusions 2 located on the wall 3 between the first plurality 2*a* and the end 7. The plurality 2*b* is in alignment with the plurality 2*a* along the longitudinal direction 8, and adjacent ones of the plurality of protrusions 2*b* have a spacing $d_{2b}$ in the longitudinal direction 8. The number of protrusions 2 in a second plurality 2*b* can be the same as the number of protrusions 2 in a first plurality 2*a* (as it is in the exemplary embodiment of FIG. 5A), or it can alternatively be greater than or less than the number of protrusions 2 in a first plurality 2*a*. The protrusions 2*b* are aligned with one another such that a plane generally normal to the broad and flat side 3 passes through a centroid of each of the protrusions 2*b*. Also, the protrusions 2*b* are aligned with the protrusions 2*a* such that the plane that passes through the centroid of each of the protrusions 2*b* is co-planar with the plane that passes through the centroid of each of the protrusions 2*a*.

The spacing $d_{2b}$ may be equal to the spacing $d_{2a}$ (as it is in the exemplary embodiment of FIG. 5A), or it may alternatively be greater than or less than the spacing $d_{2a}$. The first plurality 2*a* and the second plurality 2*b* of protrusions 2 are spaced apart from one another such that the distance $d_{2a\text{-}2b}$ is greater than the spacing $d_{2a}$. The distance $d_{2a\text{-}2b}$ is the spacing between the protrusion 2 in the plurality 2*a* that is furthest from the end 6, and the protrusion 2 in the plurality 2*b* that is nearest the end 6.

As can be further seen in FIG. 5A, the exemplary tube 1 includes a third plurality 2*c* of protrusions located along the wall 4 and aligned along the longitudinal direction 8 with the first and second pluralities 2*a* and 2*b*. The protrusions 2 within the third plurality 2*c* have a spacing $d_{2c}$ between adjacent ones of the plurality 2*c*. The third plurality 2*c* is shifted along the longitudinal direction 8 relative to the second plurality 2*b* so that at least one of the third plurality 2*c* is located between two adjacent ones of the second plurality 2*b* along the longitudinal direction 8. The number of protrusions 2 within the third plurality 2*c* can vary independently from the number of protrusions 2 in either the first plurality 2*a* or the second plurality 2*b*.

When a tube 1 is utilized in a heat exchanger, a flow of fluid can be directed into the fluid volume 12 at the first tube end 6 to flow through the tube 1 in the longitudinal direction 8, and can be removed from the fluid volume 12 at the second tube end 7. As a portion of the flow encounters one of the pluralities of protrusions 2 (for example, the plurality 2*a*), these protrusions can cause the boundary layer to transition to turbulence, thereby effecting a high convective film coefficient.

Figure 5B:
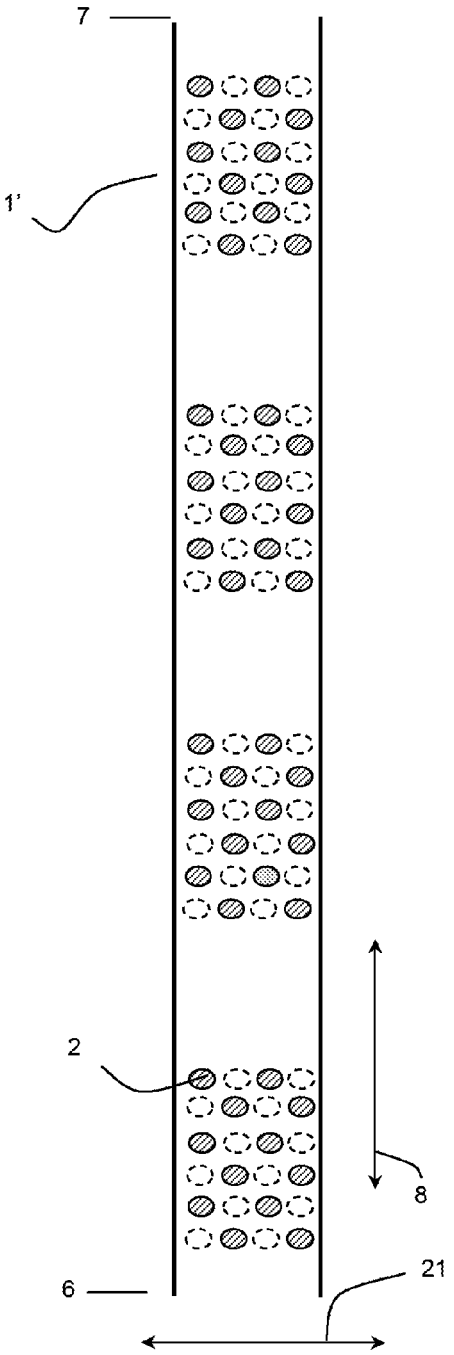

Depending on the characteristics of the fluid and the specific tube 1 and protrusion 2 geometry, multiple successive protrusions 2 in relatively close proximity can be required in order to fully transition the boundary layer into a turbulent flow regime. In the exemplary embodiment of FIG. 5A, the first plurality 2*a* of protrusions 2 consists of two of the protrusions 2, but it should be understood that other embodiments can include additional protrusions 2 in a first plurality 2*a*. For example, the tube 1' shown in FIG. 5B is similar to the tube 1 of FIG. 5A, but has three protrusions 2 in each plurality of protrusions. The number of protrusions 2 within the plurality 2*a*, and the spacing $d_{2a}$ between those protrusions 2, can be advantageously selected in order to accomplish the desired effect of a fully transitioned turbulent flow, thus corresponding with the maximum convective film coefficient as shown in FIG. 4.

If the protrusions 2 were to continue with a similar spacing down the length of the tube 1, then the laminar sublayer shown in FIG. 4 would not be able to develop, and the film coefficient could be maintained at the maximum level. Such operation may be desirable in order to maximize the rate of heat transfer, but it has the undesirable side-effect of increasing the pressure drop experienced by the fluid in passing through the tube 1. As previously indicated, this pressure drop is, quite often, a critical factor in the design of a heat exchanger employing such dimpled tubes, since the pumping power required to propel the fluid through the tubes will increase with the pressure drop, and the pumping power is often in limited supply. In order to reduce the pressure drop, additional tubes may need to be added in parallel, but this will then tend to decrease the film coefficient, as well as adding additional size and cost.

The inventors have found that an advantageous compromise between heat transfer and pumping power can be achieved by having the region $d_{2a\text{-}2b}$ of the wall 3 immediately downstream of the first plurality 2*a* of protrusions 2 be absent of additional protrusions. A flow of fluid passing through such a tube 1 is tripped into turbulence by passing over the first plurality 2*a* of protrusions 2, but the laminar sublayer is then allowed to develop over the region $d_{2a\text{-}2b}$. The film coefficient will decrease slightly over this un-dimpled region, but the pressure drop associated with the flow of the fluid will also decrease. When the flow of fluid reaches the second plurality 2*b* of protrusions, the flow is again tripped into turbulence in order to temporarily reestablish the desirable high heat transfer coefficient. Additional pluralities of protrusions 2 separated by un-dimpled regions can continue as required down the length of the tube 1.

The inventors have found that with appropriate selection of the spacing between pluralities of protrusions 2, the heat transfer performance of a heat exchanger using such a tube 1 is only slightly decreased, but the pressure drop is substantially decreased. For example, the inventors have found that in vehicular radiators, an un-dimpled spacing $d_{2a-2b}$ that is in the range of 2 to 6 times the spacing $d_{2a}$ between protrusions can provide an especially favorable trade-off between heat transfer performance and pressure drop. In some especially preferable embodiments, the un-dimpled spacing $d_{2a-2b}$ is at least 2.5 times the spacing $d_{2a}$.

Figure 5C:
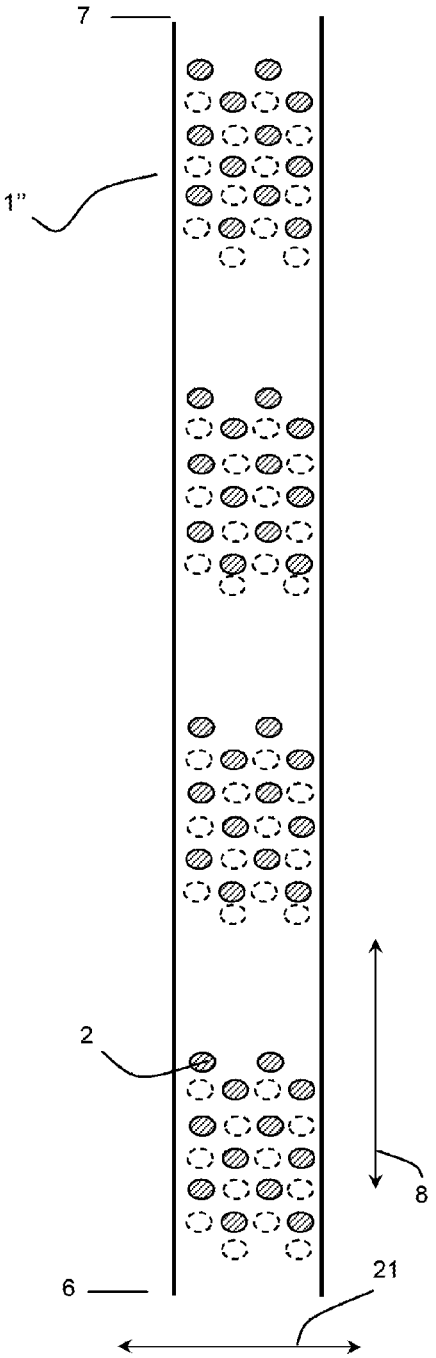

As can be seen in the various embodiments of FIGS. 5A-5C, multiple pluralities of protrusions 2 can be arranged along the transverse direction 41 of the tube 1, 1', 1". The protrusions 2 can be arranged so that the flow is tripped into turbulence at approximately the same locations in the longitudinal direction 8 across the entire transverse direction 21 of the tube 1, 1', as shown in FIGS. 5A and 5B. Alternatively, the pluralities of protrusions can be staggered as shown in the tube 1" of FIG. 5C.

Figure 6:
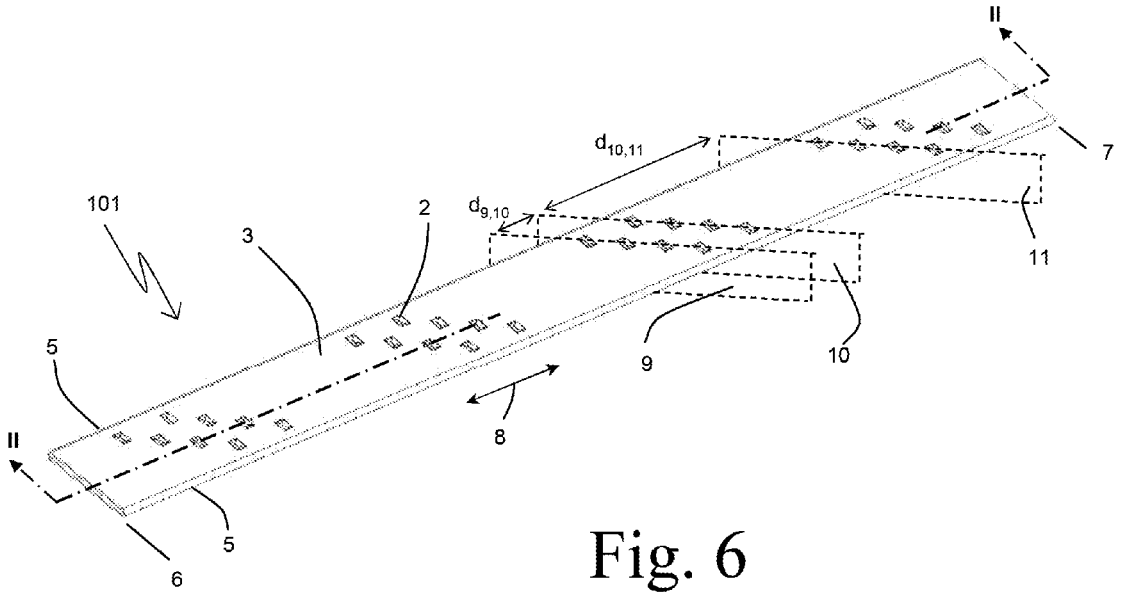
FIG. 6 is a perspective view of a tube according to an alternate embodiment of the invention.
Figure 7:
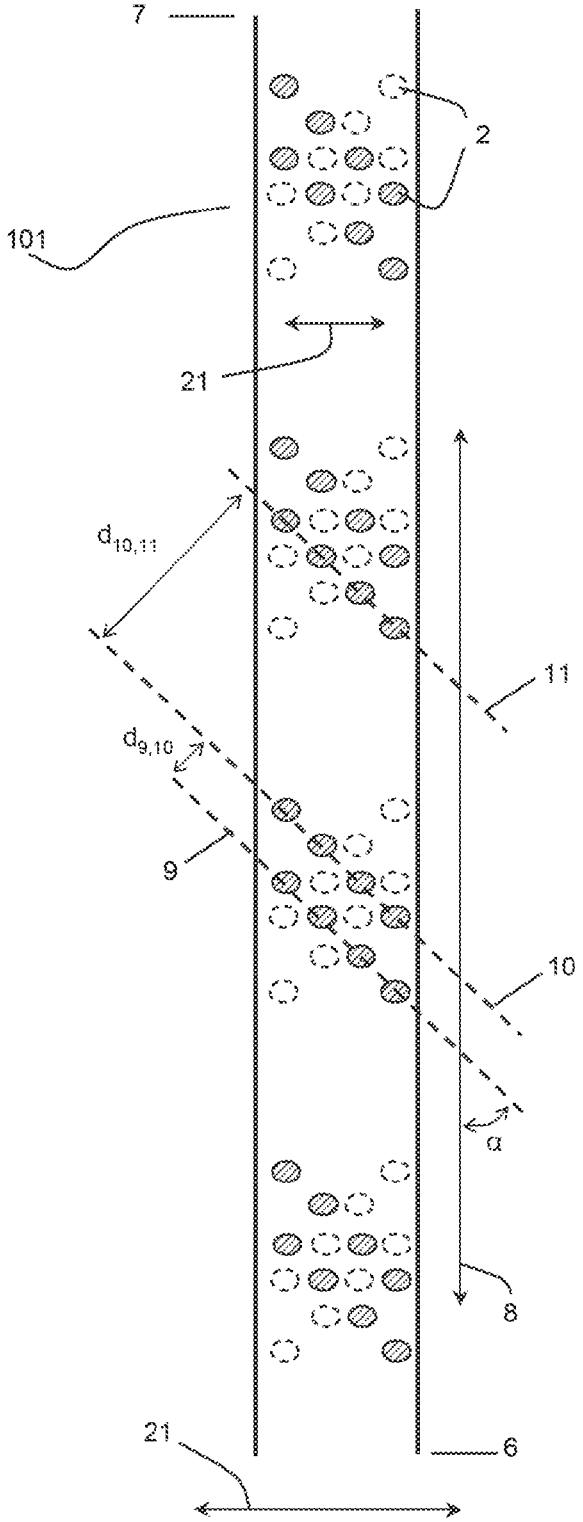
FIG. 7 is a plan view of a tube according to the embodiment of FIG. 6.

FIGS. 6 and 7 depict an alternative embodiment of a tube 101 with another stagger pattern for the protrusions 2. As before with respect to FIGS. 5A-5C, in FIG. 7 the protrusions 2 located on the wall 3 of the tube 101 are represented by un-hatched circles, whereas the protrusions 2 located on the opposing wall 4 of the tube 101 are represented by hatched circles. In the exemplary tube 101, the protrusions 2 are arranged in groupings that extend along the transverse direction 21, with successive protrusions 2 within each grouping being located progressively further along the tube 101 in the longitudinal direction 8.

With continuing reference to FIGS. 6 and 7, the protrusions 2 are arranged so that a first plurality of the protrusions 2 located on the wall 3 (the plurality numbering four protrusions in the exemplary embodiment) lies in a plane 9 passing through the centroids of those protrusions, wherein the plane 9 is perpendicular to the broad flat walls 3 and 4, but is non-perpendicular to both the longitudinal direction 8 and the transverse direction 21. A second plurality of protrusions 2 also located on the wall lie in a plane 10 (i.e. the pane 10 passes through the centroids of the second plurality of protrusions 2) that is parallel to and spaced apart from the plane 9. The wall 3 is absent of protrusions between the planes 9 and 10.

A third plurality of the protrusions 2 likewise lies in a third plane 11 parallel to, and spaced apart from, the planes 9 and 10. Again, the section of the wall 3 between the plane 10 and the plane 11 is absent of protrusions. The distance $d_{10,11}$ between the planes 10 and 11 is substantially greater than the distance $d_{9,10}$ between the planes 9 and 10.

As a flow of fluid passes through the tube 101, the relatively close spacing $d_{9,10}$ between the protrusions in the first and second pluralities of protrusions 2 can trip the flow into a turbulent regime, resulting in a favorably high heat transfer coefficient. As the flow next encounters the un-dimpled section between the planes 9 and 10, a laminar sublayer is allowed to develop in order to effect the aforementioned trade-off between fluid pressure drop and heat transfer performance. The inventors have found that having the distance $d_{10,11}$ be in a range of approximately 2.5 to approximately 6 times the distance $d_{9,10}$ can provide an especially favorable balance between the competing concerns of maximizing heat transfer and minimizing pressure drop. In other embodiments, the distance $d_{10,11}$ be at least 2 times the distance $d_{9,10}$.

By having the planes 9, 10, 11 oriented at a non-perpendicular angle to the longitudinal direction 8 (the angle indicated as "α" in FIG. 7), the inventors have found that certain additional benefits can be achieved, especially in applications wherein heat is being transferred between a first fluid passing through the tube 101 in the longitudinal direction 8, and a second fluid passing over the outer surfaces of the tube in the transverse direction 21 (i.e., a cross-flow orientation). The internal heat transfer coefficient is expected to slightly but steadily decrease between the planes 10 and 11, due to the formation of the laminar sub-layer. Consequently, the local heat transfer coefficient in the un-dimpled region between the planes 10, 11 is expected to be at its maximum value immediately downstream from a protrusion 2 of the plurality of protrusions defining the plane 10, and at its minimum value immediately upstream from a protrusion 2 of the plurality of protrusions defining the plane 11. By orienting the planes at a non-perpendicular angle α, these local maxima and minima are staggered with respect to the transverse direction 21. As a result, a fluid passing over the outer surfaces of the tube 101 in cross-flow heat transfer relation with a fluid passing through the tube 101 will experience a more uniform rate of heat transfer. The inventors have found that an angle a ranging between 15° and 75° can provide favorable results in some applications, and that an angle α ranging between 30° and 60° can be especially favorable.

As best seen in FIG. 7, the protrusions 2 can be arranged so that those protrusions 2 located on the wall 4 form a mirror image of those protrusions 2 located on the wall 3. In other words, the protrusions 2 on the wall 4 are arranged so as to lie in multiple parallel planes which are oriented at an angle of 2α to the planes in which the protrusions 2 on the wall 3 lie. In some other embodiments, however, the planes in which the protrusions 2 on the wall 4 are located can be oriented at other angles. For example, the planes in which the protrusions 2 on the wall 4 lie can be oriented to be parallel to the planes in which the protrusions 2 on the wall 3 lie.

In the exemplary embodiment of FIG. 7, the protrusions 2 are also arranged so the dimpled and un-dimpled regions of the tube wall 3 and the tube wall 4 are at coincident locations along the longitudinal direction 8. It should be recognized, however, that those dimpled and un-dimpled regions can also or alternatively be staggered along the longitudinal direction 8 in some embodiments.

As discussed with reference to FIGS. 5A-5C, it can be desirable to provide additional protrusions 2 in the dimpled regions in order to trip the fluid into turbulence. In some alternate embodiments, such additional protrusions can be arranged to lie in additional planes parallel to planes 9 and 10.

The protrusions 2 of the embodiments described above can be produced by forming the tube wall material from one or more flat strips of material. In some embodiments, pairs of rollers can be equipped with features to deform the tube wall material in order to create the protrusions 2, after which the tube wall material can be formed to create the tube. The features can be arranged on the rollers in groupings, so that dimpled sections of the tube are created over certain degrees of revolution of the rollers, and un-dimpled sections of the tube are created over certain other degrees of revolution of the rollers.

The specific geometry of the protrusions 2 can be of many different forms, as may be required by the specific heat transfer applications in which the tube is intended to be applied. By way of example only, the protrusions 2 can have footprints that include circular, oval, triangular, square, rectangular, chevron, or other shapes as may be desirable. Additionally, the profile of the protrusions 2 can be smooth or sharp, depending on the amount of turbulation that is desirable for the given application.

Figure 8:
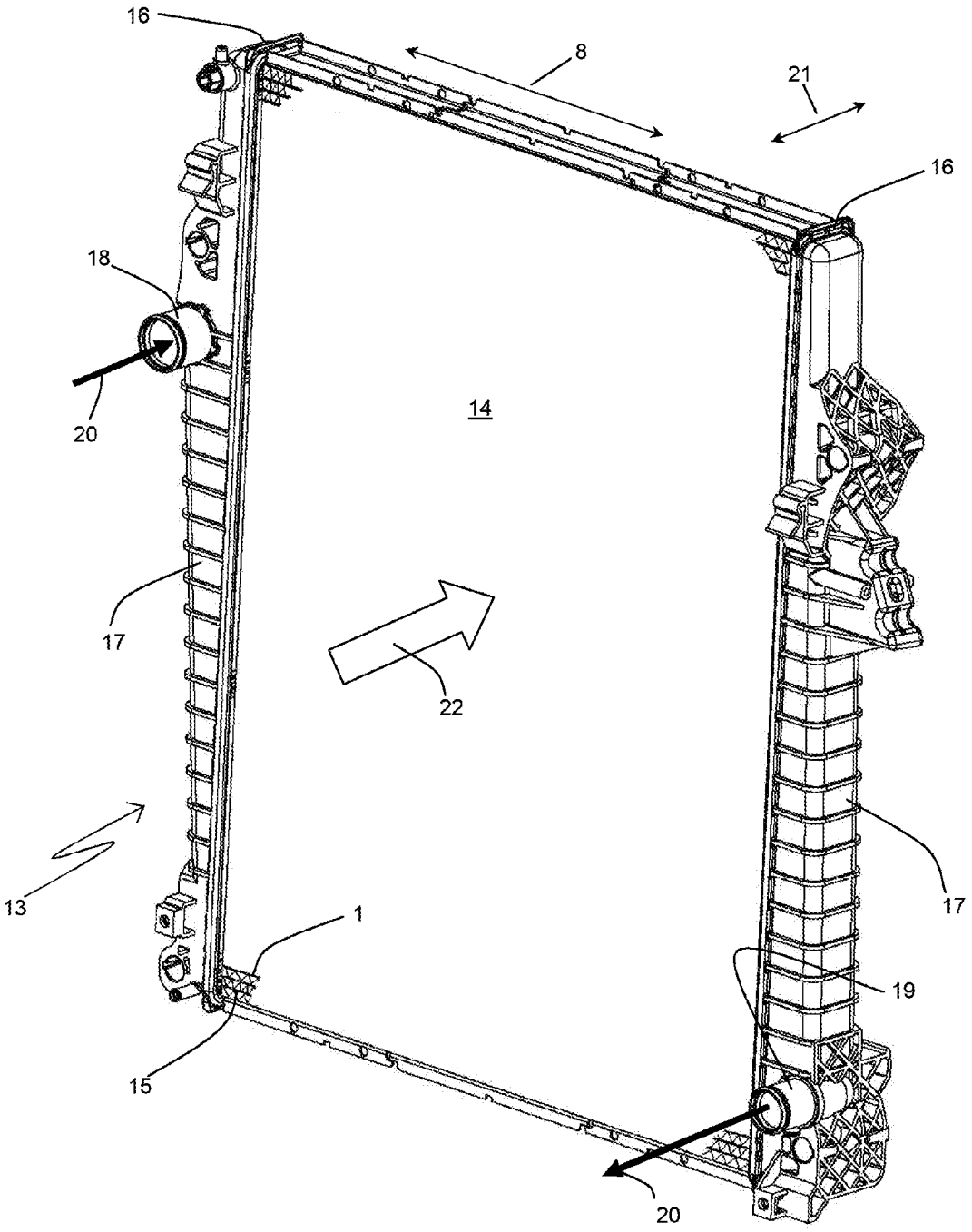
FIG. 8 is a perspective view of a heat exchanger for use with some embodiments of the present invention.
Figure 9:
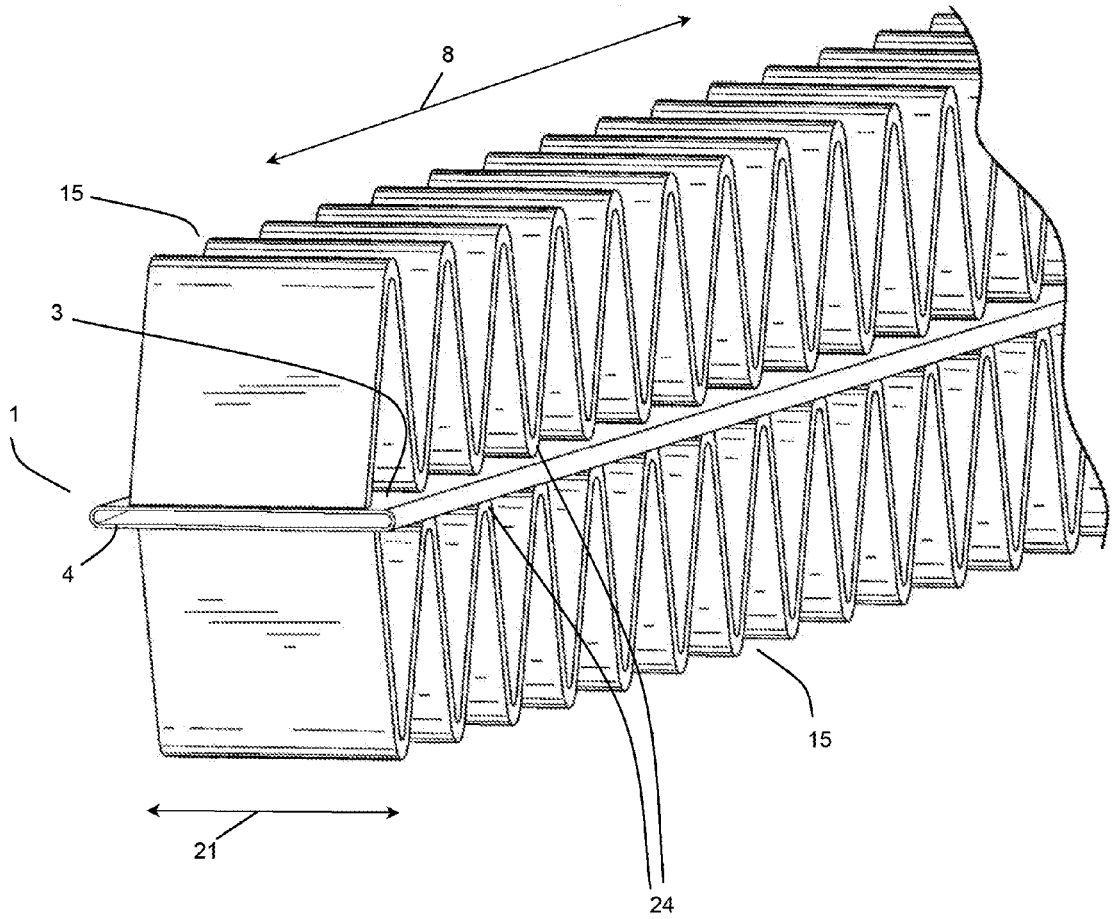
FIG. 9 is a perspective view of a portion of a tube and fins for use in the heat exchanger of FIG. 8.

FIG. 8 illustrates a heat exchanger 13 that may derive special benefit from the use of any one of the aforementioned tubes (1, 1', 1", 101) as previously described. The heat exchanger 13 includes a heat exchanger core 14 comprising interleaved tubes 1 and convoluted air fins 15. The arrangement of the tubes 1 and air fins 15 can be seen more clearly in FIG. 9. The heat exchanger 13 further includes header plates 16 located at either end of the heat exchanger core 14 to receive the ends of the tubes 1. Fluid tanks 17 are joined to the header plates 16 to define one or more fluid manifold volumes at either end of the heat exchanger core 14, with the internal passages of the tubes 1 fluidly connecting those volumes.

A flow of fluid 20 enters one of the tanks 17 through an inlet port 18, flows through the internal channels of the tubes 1 to the other one of the tanks 17, and is removed from the heat exchanger 13 through an outlet port 19 located on one of the tanks 17. In some embodiments, all of the tubes 1 can be arranged to be fluidly in parallel with one another, whereas in other embodiments the tubes 1 can be grouped into two or more groups of tubes 1, with the tubes in each group arranged to be fluidly in parallel with one another and the groups themselves arranged fluidly in series with one another. Consequently, the flow of fluid 20 may experience multiple passes through the heat exchanger core 14 between entering the port 18 and exiting the port 19, and the ports 18 and 19 may be located on opposing tanks 17 (as shown) or on the same tank 17. A second flow of fluid 22 passes through the heat exchanger core 14 in the transverse direction 21, passing over the tubes 1 and fins 15 in heat transfer relation with the fluid 20.

Such a heat exchanger 13 can find a variety of uses, including but not limited to radiators, charge-air coolers, condensers, evaporators, oil coolers, and the like. In many cases, but not always, the flow 22 is a flow of air used to heat or cool the fluid 20. The heat exchanger 13 can find especially favorable utility as a radiator for rejecting heat from the coolant water of an internal combustion engine.

Various alternatives to the certain features and elements of the present invention are described with reference to specific embodiments of the present invention. With the exception of features, elements, and manners of operation that are mutually exclusive of or are inconsistent with each embodiment described above, it should be noted that the alternative features, elements, and manners of operation described with reference to one particular embodiment are applicable to the other embodiments.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention.

What is claimed is:

1. A tube to convey a fluid through a heat exchanger, comprising:

two opposing broad and substantially flat sides extending in a longitudinal direction of the tube from a first end of the tube to a second end of the tube to at least partially define a fluid volume therebetween;

a first plurality of protrusions located between the first and second ends and extending into the fluid volume from one of the two opposing broad and substantially flat sides, said first plurality of protrusions being aligned along the longitudinal direction and having a first center-to-center spacing in the longitudinal direction between adjacent ones of said first plurality of protrusions;

a second plurality of protrusions located between the first plurality of protrusions and the second end and extending into the fluid volume from the one broad and substantially flat side, the second plurality of protrusions being aligned with the first plurality of protrusions along the longitudinal direction and having a second center-to-center spacing in the longitudinal direction between adjacent ones of said second plurality of protrusions; and a third plurality of protrusions located between the first and second ends and extending into the fluid volume from the other of the two opposing broad and substantially flat sides, said third plurality of protrusions being aligned with the first plurality of protrusions along the longitudinal direction and having a third center-to-center spacing in the longitudinal direction between adjacent ones of said third plurality of protrusions, at least one of the third plurality of protrusions being located further from the first end than any of the first plurality of protrusions and nearer to the first end than any of the second plurality of protrusions, wherein a center-to-center spacing in the longitudinal direction between one of the first plurality of protrusions located furthest from the first end and one of the second plurality of protrusions located nearest the first end is at least 2.5 times the first center-to-center spacing, and wherein said one of the first plurality of protrusions and said one of the second plurality of protrusions are separated by a portion of the one broad and substantially flat side that is absent of protrusions.

2. The tube of claim 1, wherein the center-to-center spacing in the longitudinal direction between the one of the first plurality of protrusions located furthest from the first end and the one of the second plurality of protrusions located nearest the first end is at least 2.5 times the second center-to-center spacing.

3. The tube of claim 1, wherein the first plurality of protrusions are aligned such that a first plane extends through a centroid of each of the first plurality of protrusions, and wherein the second plurality of protrusions are aligned such that a second plane extends through a centroid of each of the second plurality of protrusions.

4. The tube of claim 3, wherein the first plane and the second plane are normal to the one broad and substantially flat side.

5. The tube of claim 4, wherein the first plane and the second plane are co-planar.

6. The tube of claim 1, wherein the two opposing broad and substantially flat sides are joined by two opposing narrow sides, and wherein the longitudinal direction is parallel to the two opposing narrow sides.

7. The tube of claim 1, wherein the center-to-center spacing in the longitudinal direction between the one of the first plurality of protrusions located furthest from the first end and the one of the second plurality of protrusions located nearest the first end is less than 6 times the first center-to-center spacing.

* * * * *